United States Patent [19]

Forbes Jones et al.

[11] 4,012,227

[45] Mar. 15, 1977

[54] HIGHLY CASTABLE, WELDABLE, CORROSION RESISTANT STAINLESS STEEL

[75] Inventors: Robin Mackay Forbes Jones, Titusville; Walter Adrian Petersen, Ridgewood, both of N.J.

[73] Assignee: The International Nickel Company, Inc., New York, N.Y.

[22] Filed: June 19, 1975

[21] Appl. No.: 588,197

[52] U.S. Cl. ..... 75/122; 75/128 C; 75/128 F; 75/128 W

[51] Int. Cl.[2] ..... C22C 38/44; C22C 38/54

[58] Field of Search ..... 75/128 W, 128 F, 122, 75/128 C; 148/38, 134 F

[56] References Cited

UNITED STATES PATENTS

| | | | |
|---|---|---|---|
| 2,134,670 | 10/1938 | Parsons, Jr. | 75/128 W |
| 2,185,987 | 1/1940 | Parsons, Jr. | 75/128 W |
| 2,214,128 | 9/1940 | Fontana | 75/128 W |
| 3,892,541 | 7/1975 | Jones, et al. | 75/128 C |
| 3,900,316 | 8/1975 | Jones | 75/128 W |

*Primary Examiner*—Arthur J. Steiner
*Attorney, Agent, or Firm*—Walter A. Petersen; Ewan C. MacQueen; Raymond J. Kenny

[57] ABSTRACT

A highly-castable, ductile, corrosion-resistant and weldable stainless steel intended for exposure in marine environments. A highly satisfactory composition of the alloy is 24% Ni, 24% Cr, 4% Mo, 2% Si, 0.2% B and balance iron.

2 Claims, No Drawings

HIGHLY CASTABLE, WELDABLE, CORROSION RESISTANT STAINLESS STEEL

The invention is a stainless steel with castability improved over that of conventional stainless steel casting alloys, excellent weldability in heavy sections and exceptional resistance to corrosion.

The problem of providing an alloy suitable for the production of intricate castings, readily repair weldable, capable of being joined to other similar alloys and offering exceptional corrosion resistance has plagued the industry for many years. Although, there are a number of stainless steels in the prior art which are intended for specific applications requiring castability or weldability or corrosion resistance, an alloy superior in one of these requisite properties seldom offers the others.

Cast stainless steels described in a co-pending disclosure, now U.S. Pat. No. 3,900,316, and somewhat similar in various respects to the alloy of this invention, offer markedly improved castability; however, tests on these alloys have shown that they possess corrosion resistance only sufficient for atmospheric exposure. Furthermore, they are not joinable by welding, and in fact, brazing is specificed as the preferred method for joining.

Stainless steels and a number of other alloys that show improvements in castability due to the addition of certain constituents that lower the melting point, such as boron and silicon, generally have extremely poor weldability characteristics because these additions lead to eutectic formations which cause weld deposit and heat-affected zone cracking. Similarly, since these elements tend to segregate to interdendritic and intergranular areas, they may reduce corrosion resistance.

However, we have demonstrated elsewhere (U.S. Pat. No. 3,892,541) that highly castable nickel-base alloys can be prepared having excellent weldability as well as suitable elevated temperature properties for numerous applications, notwithstanding that boron and silicon are present. But given this, such alloys do not offer exceptional resistance to corrosion as contemplated herein, particularly in respect of corrosive chlorides. Consequently, they cannot be used for applications such as those intended for the alloy of this invention.

It has now been discovered that highly castable stainless steels can be prepared having excellent resistance to attack in chloride environments and the capability to be welded in heavy sections without cracking.

It is an object of this invention to provide improved castability over that available in presently known commercial stainless steels as well as the capability to be joined by welding and to provide exceptional corrosion resistance in chloride-containing environments.

Generally speaking, the alloy of this invention contemplates a highly castable, ductile, corrosion resistant and weldable stainless steel containing, by weight, from about 22% to about 26% chromium, from about 20% to about 30% nickel, from about 2.5% to about 5% molybdenum, from about 1.3% to about 2.7% silicon, from about 0.15% to about 0.3% boron, up to about 2% manganese, up to about 0.07% carbon and the balance iron with incidental impurities.

In carrying the invention into practice, an expecially desirable combination of castability, ductility, corrosion-resistance and weldability, along with other beneficial characteristics is obtained with a composition containing from about 23% to about 25% chromium, from about 23% to about 26% nickel, from about 3% to about 4.5% molybdenum, from about 1.5% to about 2.5% silicon, from about 0.15% to about 0.25% boron, up to about 0.7% manganese, up to about 0.05% carbon, and the balance essentially iron.

The aforedescribed alloy affords excellent casting characteristics and heats are clean and free from dross and slag during melting. It may be poured into thin as well as heavy section castings with little evidence of folds, inclusions, misruns and sand reaction or "burn-on". Complex sections having fine detail, can be reproduced readily whether in a sand casting or a permanent mold.

Finished castings may be used in the "as-cast" condition; however, it has been found that optimum mechanical properties and corrosion resistance can be obtained by a solution annealing heat treatment. Temperatures between 1800° F and 2100° F, and preferably, 2050° F, are suitable for this purpose. Castings should be held at temperature for one hour per inch of thickness followed by water quenching.

It has been found that the chromium content should be above 22% in order to obtain sufficient corrosion resistance for applications involving chloride media, such as marine hardware and fluid handling equipment for the chemical industry. Optimum ductility is obtained when the chromium content is kept below 26% since it is well to avoid the formation of the deleterious sigma phase which may cause severe embrittlement and lead to susceptibility to corrosive attack. In order to achieve a desirable combination of properties, chromium should be maintained between about 23% and 25%.

Nickel is known to be strong austenite former and is required in the alloy of our invention to maintain an austenitic structure within the matrix. The lower limit, 20%, for nickel is determined by its influence on ductility. In order to obtain useful engineering properties it is preferred that the nickel content be at least about 23%. Increasing amounts of nickel improve the ductility of the alloy without adversely affecting other properties. While as much as 30% nickel can be contained in the alloy, however, it is preferred that nickel be limited to about 26%.

The presence of molybdenum contributes to the corrosion resistance and weldability of the alloy. With molybdenum below about 2.5%, weldability is sacrificed even though ductility is substantially improved. Alloys containing less than 2.5% molybdenum are subject to heat-affected zone cracking. Because high levels of molybdenum reduce ductility, it is preferred that molybdenum be present in amounts no greater than 5% or even about 4.5%. This upper limit for molybdenum provides alloys having adequate ductility for general engineering use as well as the required weldability.

Highly useful castability is obtained in the alloys of this invention in the co-presence of boron with as little as about 1.5% or even 1.3% silicon. Alloys containing less than about 1.3% silicon do not exhibit adequate fluidity and are subject to casting defects such as folds and misruns. As silicon content increases, fluidity also increases; however, ductility of the alloy is reduced sufficiently to offset this advantage. Thus, the preferred minimum value of about 1.5% is based on the fluidity requirement and the preferred upper limit of about 2.5% is based on the need for sufficient ductility for general engineering use.

The minimum boron content of the alloy is about 0.15% which, as in the case of silicon, reflects the castability requirement for adequate fluidity and freedom from casting defects. Also, alloys containing less than about 0.15% boron can be susceptible to heat-affected zone cracking. The upper limit on this element of as much as about 0.25% or even 0.3% is based on the requirement for sufficient ductility for general engineering use.

Manganese levels, up to about 2%, but preferably not more than about 0.7%, are expected in stainless steels as a standard ingredient which acts as a deoxidant and malleabilizer. The addition of increasing quantities of this element has the same beneficial effect, although not as great as that afforded by increasing nickel content on ductility.

loy, such as Co, Cu, V, W and Zr, is contemplated and considered within the scope of this invention. However, the amount present therein should not be excessive since, for example, the addition of as little as 0.65% copper can lead to a substantial loss in ductility and as little as 1.25% copper will cause heat-affected zone cracking during welding.

For the purpose of giving those skilled in the art a better understanding of the invention, the following illustrative examples are given.

EXAMPLES

The compositions of the melts produced in accordance with the invention as well as several alloys outside of the invention are set forth in Table I. The alloys within the invention are identified numerically whereas the alloys outside the invention are identified alphabetically.

TABLE I

Stainless Steel Compositions and Weldability

| Alloy No. | Composition in Weight Percent, Balance Fe | | | | | | | | Bead-on-Plate Test Result |
|---|---|---|---|---|---|---|---|---|---|
| | C | Mn | Si | Ni | Cr | Mo | B | Al | |
| 1 | 0.018 | 0.72 | 1.97 | 23.7 | 23.3 | 3.2 | 0.26 | 0.11 | No Defects |
| 2 | 0.022 | 0.68 | 2.03 | 24.2 | 23.7 | 4.3 | 0.21 | 0.17 | " |
| 3 | 0.023 | 0.74 | 2.06 | 29.7 | 23.0 | 4.3 | 0.15 | 0.17 | " |
| 4 | 0.017 | 0.68 | 2.02 | 24.2 | 24.2 | 3.2 | 0.22 | 0.14 | " |
| 5 | 0.032 | 0.79 | 1.87 | 23.7 | 24.5 | 3.2 | 0.16 | 0.10 | " |
| 6 | 0.016 | 0.84 | 2.00 | 23.8 | 24.2 | 3.3 | 0.19 | 0.06 | " |
| 7 | 0.017 | 0.83 | 2.00 | 23.9 | 23.9 | 4.3 | 0.20 | 0.06 | " |
| A | 0.020 | 0.87 | 1.45 | 25.7 | 24.1 | 2.2 | 0.29 | 0.08 | Heat Affected Zone Cracking |
| B | 0.025 | 0.59 | 2.01 | 16.7 | 23.3 | 4.3 | 0.30 | 0.10 | No Defects(1) |
| C | 0.018 | 0.74 | 2.53 | 24.0 | 23.1 | 4.2 | 0.34 | 0.13 | No Defects(1) |
| D | 0.013 | 0.80 | 1.09 | 10.3 | 20.8 | 2.7 | (2) | 0.07 | No Defects(3) |
| E(1) | 0.010 | 0.83 | 1.12 | 28.9 | 19.9 | 2.1 | (2) | 0.07 | No Defects(4) |

(1)But see Table III and related text regarding tensile ductility
(2)not added
(3)Alloy Casting Institute Type CF-8M
(4)Alloy Casting Institute Type CN-7M also contained 4.3% Cu The carbon content of the alloy of this invention should be kept to a minimum since excessive carbon will reduce the corrosion resistance by precipitating chromium carbides. A maximum of about 0.07%, and preferably not more than about 0.05% carbon, is desirable in this alloy to obtain maximum resistance to corrosive attack.

A small residual amount of aluminum, about 0.1% can be expected in the alloy since this element has been found useful as a deoxidant. Although more than this amount, e.g., up to about 0.5% aluminum, might be used, an addition this large would probably cause substantial deterioration in the fluidity and consequently the castability of the alloy. Aluminum, if any is present, should not exceed 0.25% or 0.3%.

Consistent with good steelmaking practice, other elements such as titanium, columbium, magnesium and calcium, may be contained within the alloy for purposes of deoxidation. It is also highly desirable that the nitrogen content of the alloy be limited, for example, to about 0.08%, since this element will tie up chromium as a precipitate thereby reducing the corrosion resistance of the alloy. Residual elements, such as phosphorus and sulfur, should normally be kept at low levels, for example, no more than about 0.4%, because of their well known deleterious effect on the weldability of stainless steel.

The presence of other elements related to pickup from scrap materials and in the preparation of the al- (1) but see Table III and related text regarding tensile ductility
(2) not added
(3) Alloy Casting Institute Type CF-8M
(4) Alloy Casting Institute Type CN-7M also contained 4.3% Cu Experimental alloys were prepared in an air-induction furnace having a magnesia crucible. During meltdown, molybdenum was added to the charge of Armco iron and nickel. The furnace was heated to 2850° F and the remaining ingredients were added in the order: low-carbon ferrochromium, silicon-manganese, ferroboron, ferromanganese and silicon. The charge was given a final deoxidation treatment with aluminum, and poured into a variety of molds from a temperature of 2650° F. The molds consisted of green sand Chinese Puzzle Molds for castability evaluation; dry sand ½ wide × 3 high × 12 inches long and 1 wide × 3 high × 12 inches long keel blocks for mechanical property and weldability evaluations; and dry sand 4 wide × 4 high × 6 inches long keel blocks for marine exposure test specimens.

The castability test utilized a mold having a pouring spout offset from center and a series of eight square sections, 1-½ wide by 3/16 inches thick which are interconnected by ½ inches wide channels at staggered edge locations and arranged in a square configuration, 5-½ inches on a side. The casting bears a resemblance to a Chinese script figure and is referred to in the Foundry Industry as a Chinese Puzzle Mold. Castability is rated by determining (i) the number of squares filled which is related to the fluidity of the alloy, (ii) the presence or absence of folds in the individual square, (iii) the number of misruns which indicates how well the Chinese Puzzle is filled, and (iv) whether or not the metal has suffered "burn-on" or reaction with the sand. The method for rating the castability of Chinese Puzzles is based on the studies reported by D. B. Roach and A. M. Hall in their "Summary Report on Project 54 ", published by Battelle Memorial Institute on Dec. 31, 1973. In this rating system, it is desirable to fill the maximum number of squares in the puzzle, numerically 8, indicating excellent fluidity, and to obtain the lowest possible numerical rating in the fold, misrun and burn-on categories.

Table II shows the results of castability ratings for the preferred alloys, numbers 1 through 4 and compares these to values obtained on commercial cast stainless steel of the Alloy Casting Institute type CF-8M (20% Cr, 10% Ni, 3% Mo, 1% Si, Bal Fe).

TABLE II

| | Castability Ratings (1) | | | | |
|---|---|---|---|---|---|
| Alloy No. | Pouring Temp., °F | Fluidity, No. of Squares Filled | Fold Rating | Misrun Rating | Burn-On Rating |
| 1 | 2650 | 7 | 5 | 8 | 4 |
| 2 | 2650 | 6 | 7 | 7 | 3 |
| 3 | 2650 | 8 | 7 | 5 | 5 |
| 4 | 2650 | 7.5 | 6 | 7 | 4 |
| CF-8M | 2975 | 7 | 12 | 11 | 24 |

(1) Optimum fluidity is represented by all squares being filled or the number 8, whereas, fold, misrun and burn-on ratings are preferred to be as low as possible.

The alloys of this invention had the same fluidity rating as CF-8M, yet show an advantage since they were poured from a temperature of 2650° F, whereas, the CF-8M was poured from 2975° F. In addition, there were far fewer folds in Chinese Puzzles made with these alloys than with the CF-8M. Misruns, defects which result from incomplete filling of the mold, were also limited in the alloys of this invention. When CF-8M is poured from a temperature of 2650° F, numerous cold shuts and misruns as well as poor fluidity is observed. Because of the lower pouring temperature of the castings of our invention, there is less tendency for sand from the mold surface to burn-on or react with the surfaces.

The weldability of experimental alloys was evaluated with a gas tungsten-arc bead-on-plate test and with a heavily restrained ½ inch thick butt joint. The bead-on-plate test represents a simple method for screening weldability which consists of running an autogenous welding bead on the surface of the test piece using a ⅛ inch diameter tungsten electrode at 11 volts, 200 amperes direct-current straight-polarity and a travel speed of 16 inches per minutes. The resultant weld deposit and heat-affected zone are subsequently examined microscopically at 10 magnifications for evidence of weld and heat-affected zone cracking. Alloys showing cracking are screened from further examination and considered unweldable. All of the numerically designated alloys, 1 through 7 in Table I, were found to meet the requirements of this test in that they were free from weld and heat-affected zone cracking. Alloy A in Table I is an example of a material that exhibits unsatisfactory weldability in this test. Numerous heat-affected zone cracks were observed in this alloy containing 2.2% molybdenum which is outside the specific molybdenum composition range for the alloy of our invention.

The resistance of the preferred alloy to heat-affected zone and weld deposit cracking was shown in a ½ thick × 3 inch wide × 6 inch long 60° Vee butt joint prepared in Alloy 5. A special wrought filler, similar in composition to the material being welded, was used for this weld. The joint was restrained by clamping to a 3 inch thick cast iron platen. A gas tungstenarc weld was completed in 9 passes at a current of 200 amperes direct-current straight-polarity, 17 volts with manual travel speed estimated at 2.5 inches per minute.

Subsequent to welding, the joint was cut into 178 inches wide transverse slices, polished on a rubber bonded abrasive wheel, etched with Lepito's reagent and examined for cracking at 10 magnifications. All weld slices were free from cracking showing that the alloy of this invention possesses adequate weldability for both repair of defective castings and for fabrication into an assembly.

The mechanical properties of Alloys 1 through 4 representing preferred compositions are shown in Table III as well as typical mechanical properties for Alloy Casting Institute alloys CF-8M and CN-7M. Ductility values in terms of elongation and reduction of area, for the preferred alloys are somewhat below those of commercial stainless steel castings; however, they are entirely suitable for the majority of engineering applications. Similar results were obtained on transverse slices cut from the ½ inch thich weld in Alloy 5. Annealing improves the ductility of the alloys of this invention.

TABLE III

| | | Mechanical Properties | | | |
|---|---|---|---|---|---|
| Alloy No. | Condition | 0.2% offset Y.S., Ksi | Ultimate Tensile Strength, Ksi | Elong. in 1", % | Reduction of area, % |
| 1 | As cast | 32.6 | 61.8 | 10.0 | 12.0 |
| | annealed | 37.9 | 69.0 | 13.0 | 13.5 |
| 2 | As cast | 32.7 | 60.6 | 12.0 | 15.2 |
| | annealed | 37.4 | 66.3 | 16.0 | 18.1 |
| 3 | As cast | 32.2 | 62.3 | 15.0 | 16.7 |
| | annealed | 36.1 | 70.8 | 24.0 | 26.1 |
| 4 | As cast | 31.0 | 61.0 | 16.0 | 18.5 |
| | annealed | 33.7 | 69.9 | 20.0 | 26.8 |
| 5 | As cast (1) | 48.9 | 74.2 | 7.0 | 10.8 |
| | annealed (1) | 42.8 | 85.4 | 22.5 | 25.2 |
| B | As cast | 42.2 | 73.4 | 5.0 | 8.0 |
| | annealed | 44.6 | 77.4 | 6.0 | 5.5 |
| C | As cast | 36.2 | 61.2 | 6.0 | 5.5 |
| | annealed | 40.6 | 66.7 | 9.0 | 10.0 |
| CF-8M | annealed | 42.0 | 80.0 | 50.0 | |

TABLE III-continued

| Alloy No. | Condition | Mechanical Properties 0.2% offset Y.S., Ksi | Ultimate Tensile Strength, Ksi | Elong. in 1", % | Reduction of area, % |
|---|---|---|---|---|---|
| CF-7M | annealed | 31.5 | 69.0 | 48.0 | |

(1) Tensile test results were obtained on transverse slices cut from a welded joint in ½" plate. Test bar broke in weld deposit. Elongation was non-uniform and limited to the weld deposit.

Alloy B in Table III, which contained only 16.7 % nickel, illustrates the need for nickel contents above 20% and preferably above about 23%. The low ductility exhibited by the alloy in the tensile test, i.e., 5% elongation as-cast, 6% elongation annealed, was considered insufficient for engineering applications.

The effect of high silicon and boron contents on ductility was demonstrated by heat C. This alloy had suitable casting characteristics and contained 2.53% silicon and 0.34% boron, however, the elongation and the reduction of area values were lower than desirable as shown in Table III.

Since one of the intended major service areas for the alloys of this invention involves chloride media such as that encountered in a marine environment, corrosion tests involved exposure to sea-air, splash and spray conditions. Panels, ⅛ × 4 × 6 having an 80 microinch finish, were exposed flat on the deck of a small boat and vertically on a dock, both located in Harbor Island, North Caroline. The panels had been cut and machined from 4 wide × 4 high × 6 inches long keel block sand castings. All panels contained an autogenous gas tungstenarc weld bead along the centerline on the outer exposed surface for their length (200 amperes D.C.S.P., 11 volts, 16 ipm travel speed). The panels were tested in the: (1) as-cast and welded condition and (2) post-weld annealed condition (1 hour/2050° F/W.Q.).

As shown in Table IV, after 6 months exposure, the alloys representative of this invention, Alloy Nos. 6 and 7 containing 3.3% and 4.3% molybdenum respectively, shown corrosion resistance superior to both cast CF-8M (Alloy D) and CN-7M (Alloy E). CF-8M and CN-7M are considered to offer excellent resistance to corrosive attack in this environment.

TABLE IV

Corrosion Resistance In Sea-Air Splash And Spray Tests After 6 Months Exposure

| Alloy No. | Alloy Type | Condition | Exposure Location | Comment |
|---|---|---|---|---|
| 6 | 3% Mo | As-cast + welded | Boat | 25% very light staining, crevice corrosion |
| 6 | 3% Mo | As-cast + welded | Float | <5% very light staining |
| 6 | 3% Mo | Welded + 1 hr/2050° F/W.Q. | Boat | 25% very light staining, crevice corrosion |
| 6 | 3% Mo | Welded + 1 F/W.Q. | Float | No visible corrosion |
| 7 | 4% Mo | As-cast + welded | Boat | 25% very light staining, crevice corrosion (1) |
| 7 | 4% Mo | As-cast + welded | Float | <5% very light staining |
| 7 | 4% Mo | Welded + 1 hr/2050° F/W.Q. | Boat | 25% very light staining, crevice corrosion (1) |
| 7 | 4% Mo | Welded + 1 hr/2050° F/W.Q. | Float | <1% very light staining |
| D | CF-8M | As-cast + welded | Boat | 10% light rust spots, 75% light staining, significant crevice corrosion |
| D | CF-8M | As-cast + welded | Float | 5% moderate rust spots, <5% light staining |
| D | CF-8M | Welded + 1 hr/2050° F/W.Q. | Boat | 50% very light staining |
| D | CF-8M | Welded + 1 hr/2050° F/W.Q. | Float | Few light rust spots and <1% very light staining |
| E | CN-7M | As-cast + welded | Boat | 50% very light staining, crevice corrosion (1) |
| E | CN-7M | As-cast + welded | Float | <1% very light staining |
| E | CN-7M | Welded + 1 hr/2050° F/W.Q. | Boat | 50% very light staining, crevice corrosion (1) |
| E | CN-7M | Welded + 1 hr/2050° F/W.Q. | Float | One moderate rust spot and <1% very light staining |

(1) Crevice corrosion starting at insulated fasteners.

Only very light staining was present in the as-cast samples. The annealing heat treatment offered some improvement in corrosion resistance by almost completely eliminating the presence of the light staining. Welding did not cause any susceptibility to accelerated corrosion since there was no preferential or general attack in the weld deposit or adjacent heat-affected zones. These tests demonstrate the usefulness of the alloys of this invention in a marine environment.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

We claim:

1. A highly-castable, ductile, corrosion resistant and weldable stainless steel consisting essentially of, by weight, from about 22% to about 26% chromium, from about 20% to about 30% nickel, from about 2.5% to about 5% molybdenum, from about 1.3% to about 2.7% silicon, from about 0.15% to about 0.3% boron, up to about 2% manganese, up to about 0.07% carbon, and the balance iron with incidental impurities, said stainless steel characterized by sea-air, splash and spray corrosion resistance superior to that exhibited by commercial stainless steels CN-7M and CN-8M and exhibiting freedom from heat-affected zone and weld deposit cracking and being further characterized by a minimum elongation in the room temperature tensile test of at least 10% in the as cast condition.

2. A stainless steel as defined in claim 1 containing from about 23% to about 25% chromium, from about 23% to about 26% nickel, from about 3% to about 4.5% molybdenum, from about 1.5% to about 2.5% silicon, from about 0.15% to about 0.25% boron, up to about 0.7% manganese, up to about 0.05% carbon, and the balance essentially iron.

* * * * *